United States Patent [19]

Lamb, Sr. et al.

[11] Patent Number: 4,716,709

[45] Date of Patent: Jan. 5, 1988

[54] APPARATUS AND METHOD FOR ROLL WRAPPING WITH POLY-COATED PAPER

[75] Inventors: Vernon L. Lamb, Sr.; Stanley A. Helmer, both of Sparta, Mich.

[73] Assignee: Howard City Paper Company, Howard City, Mich.

[21] Appl. No.: 915,730

[22] Filed: Oct. 6, 1986

[51] Int. Cl.[4] ..... B65B 11/04

[52] U.S. Cl. ..... 53/399; 53/465; 53/587; 53/214; 53/389; 53/463

[58] Field of Search ..... 53/399, 465, 389, 587, 53/463, 214, 210, 211

[56] References Cited

U.S. PATENT DOCUMENTS

| | | | |
|---|---|---|---|
| 1,573,669 | 2/1926 | Bolingbroke | 53/214 |
| 2,746,224 | 5/1956 | Wollett | 53/214 |
| 2,803,935 | 8/1957 | Gibson | 53/380 |
| 2,938,319 | 5/1960 | Nystrand | 53/214 |
| 2,962,852 | 12/1960 | Hedquist | 53/587 |
| 3,416,491 | 12/1968 | Turnbull et al. | 118/411 |
| 3,429,097 | 2/1969 | Jasper et al. | 53/214 |
| 3,659,394 | 5/1972 | Hartleib | 53/214 X |
| 3,716,964 | 2/1973 | Reynolds | 53/389 |
| 3,719,021 | 3/1973 | Rosenberg | 53/551 |
| 3,816,969 | 6/1974 | Zimmerman | 53/210 X |
| 4,144,696 | 3/1979 | Gustavsson | 53/587 X |
| 4,189,894 | 2/1980 | Laing | 53/587 |

*Primary Examiner*—John Sipos

*Attorney, Agent, or Firm*—Price, Heneveld, Cooper, DeWitt & Litton

[57] ABSTRACT

The specification discloses an apparatus and method for wrapping paper rolls with a paper coated with a thermoplastic material. The leading edge of the wrapper is adhered to the roll by softening the thermoplastic. After the wrapper is wrapped about the roll, the trailing edge of the wrapper is adhered to the wrapped roll by softening the thermoplastic. The wrapping apparatus includes a heatable transport bar for heating the desired portions of the wrapper and contacting the heated portions to the roll.

9 Claims, 8 Drawing Figures

APPARATUS AND METHOD FOR ROLL WRAPPING WITH POLY-COATED PAPER

BACKGROUND OF THE INVENTION

The present invention relates to paper manufacturing equipment, and more particularly to roll wrapping machines.

When manufacturing paper, it is common to wrap the completed rolls with a heavy paper for protection during subsequent shipment and/or storage. The paper wrapped about the roll is known as a "roll wrapper" and is typically a kraft paper to protect the paper roll from marking and moisture damage.

Typically, roll wrapping machines use liquid adhesive to secure the roll wrapper about the paper roll. Exemplary machines are illustrated in U.S. Pat. No. 3,416,491, issued Dec. 17, 1968, to Turnbull et al, entitled LEADING EDGE GLUER; U.S. Pat. No. 2,938,319, issued May, 31, 1960, to Nystrand, entitled APPARATUS FOR HANDLING CYLINDRICAL OBJECTS; U.S. Pat. No. 2,803,935, issued Aug. 27, 1957, to Gibson, entitled ROLL WRAPPING MACHINE; and U.S. Pat. No. 2,746,224, issued May 22, 1956, to Wollett, entitled WRAPPING MACHINE. However, the liquid adhesive applicators are inherently sloppy creating an unsightly wrapped roll. Further, the adhesive applicators require maintenance and servicing, resulting in down-time.

SUMMARY OF THE INVENTION

The aforementioned problems are overcome in the present invention comprising a roll wrapping machine eliminating the need for liquid adhesive applicators. More particularly, the present invention is directed to an apparatus and method for wrapping paper rolls with a paper coated with a thermoplastic, using the softened thermoplastic as the adhesive to secure the wrapper about the roll.

The present method includes the steps of (1) providing a wrapper coated on one side with a thermoplastic, (2) adhering the leading edge of the wrapper to the paper roll by softening the thermoplastic, (3) wrapping the wrapper about the roll, and (4) adhereing the trailing edge of the wrapper to the roll by softening the thermoplastic. The present apparatus includes structure for implementing this defined method.

The presently defined method and apparatus totally eliminate the need for liquid adhesive applicators, and the attendant maintenance, servicing, and down-time. Further, the wrapped rolls have a neat and attractive appearance without liquid glue slopped about the roll wrapper. Third, the poly-coating on the roll wrapper inproves moisture protection of the roll.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
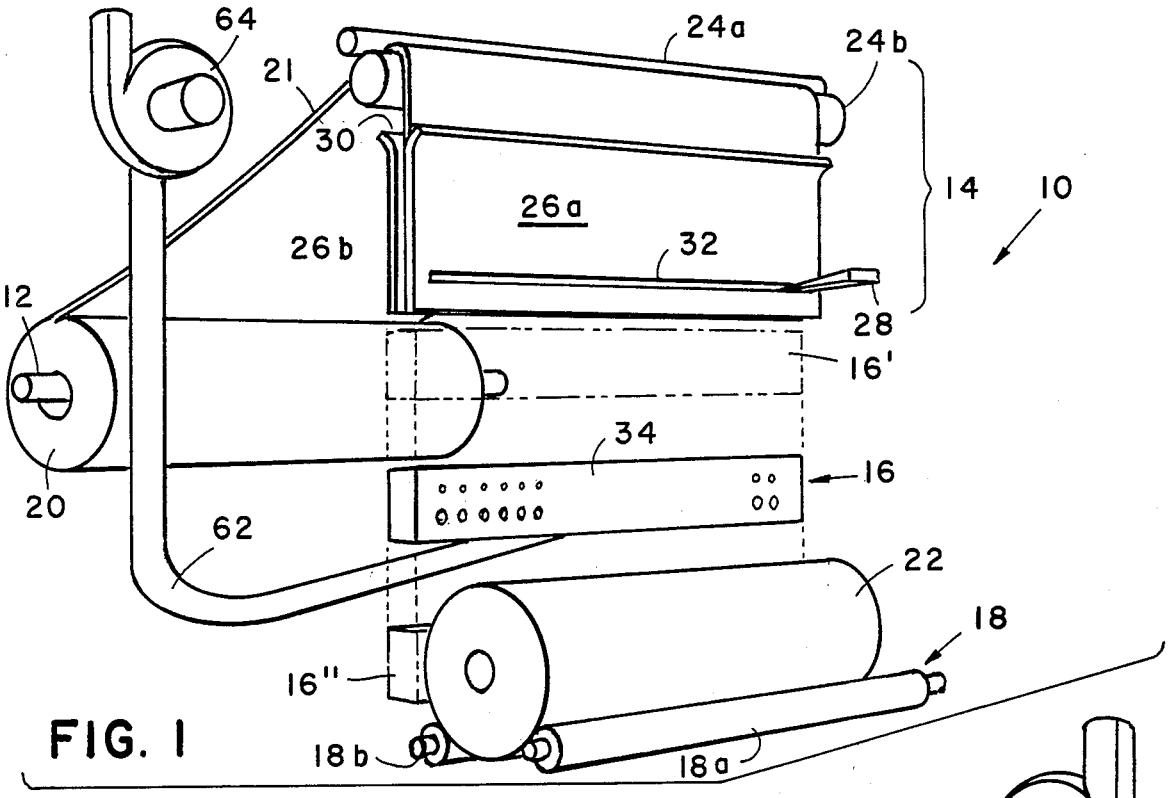
FIG. 1 is a front perspective view of the present roll wrapping machine.
Figure 2:
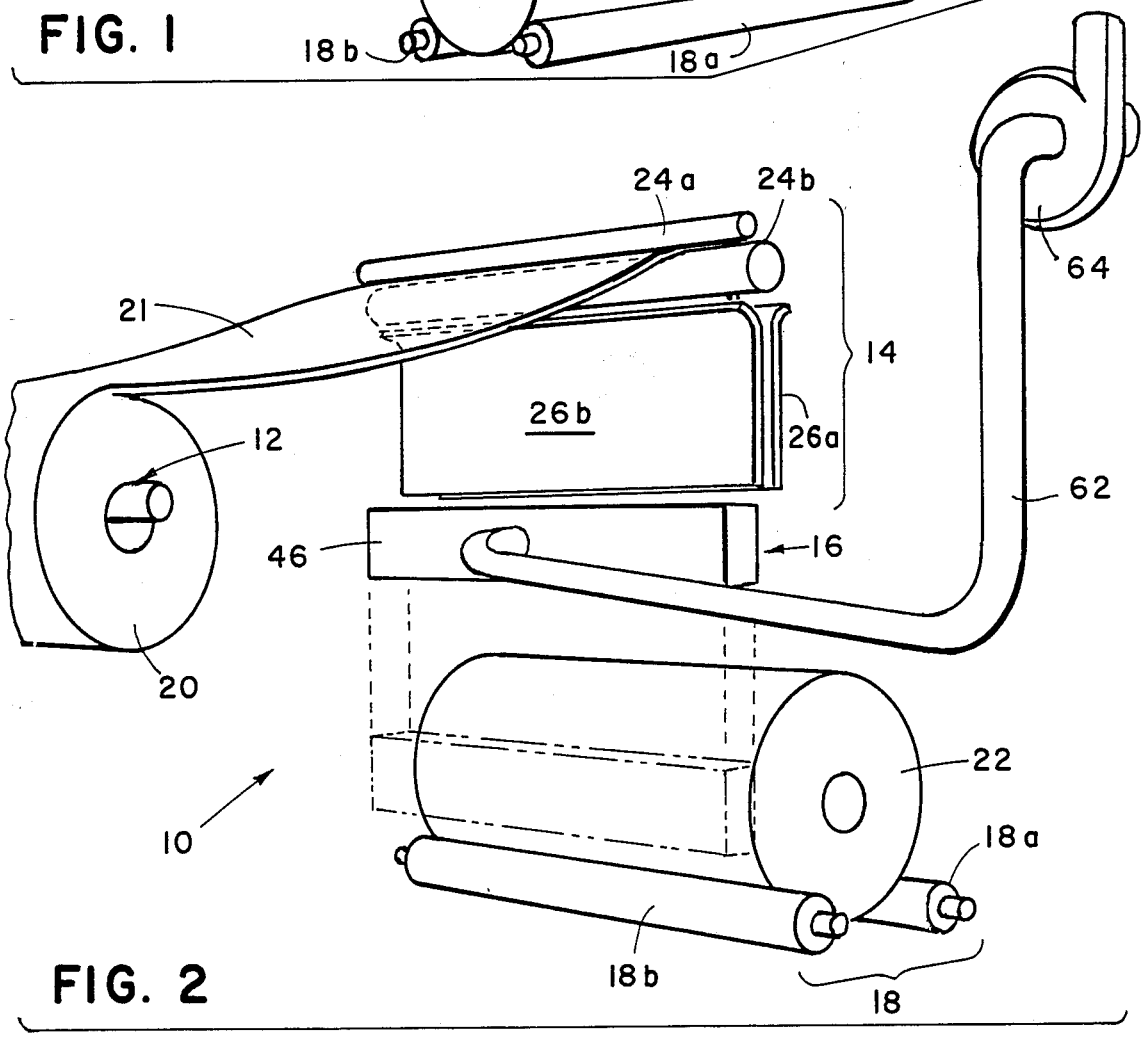
FIG. 2 is a rear perspective view of the roll wrapping machine.

A roll wrapping machine constructed in accordance with a preferred aspect of the invention is illustrated in FIGS. 1–6 and generally designated 10. Basically, the machine 10 includes a wrapper roll support 12, a wrapper dispensing assembly 14, a gripper bar 16, and a roll support assembly 18. A roll 20 of roll wrapping material is supported on the support 12; and a paper roll 22 to be wrapped is supported on the support assembly 18. The roll wrapper material 21 having a thermoplastic coating is dispensed by the assembly 14; and as the wrapper material is dispensed, the heater bar moves upwardly and downwardly to convey the leading and trailing edges of each wrapper to the paper roll. The gripper bar 16 is heatable to tackify the thermoplastic on the roll wrapper and thereby adhere the roll wrapper to the roll. Only the leading and trailing edges of the wrapper need be heated as will be described.

Wrapper roll suppert 12, dispensing assembly 14, and roll support assembly 18 are generally well known to those having ordinary skill in the art and will not be described in detail. Exemplary roll wrapping machines incorporating this structure are those sold by Lambs-Gray Harbor Company of Hoaquiam, Wash.

The wrapper roll support 12 is a conventional support comprising an axle supported on a back stand (not shown). Optionally, multiple supports can be provided for multiple wrapping rolls to accomodate rolls of varying widths and materials. If multiple rolls are included, a selector mechanism is also provided for selecting the appropriate wrapper material for each paper roll.

The wrapping material roll 20 is rotatably supported by the support 12 for subsequent delivery to the dispensing assembly 14. In the preferred embodiment, the wrapping material is a 42-pound kraft paper coated with polyethylene at a rate of approximately 14.4 pounds per basis (i.e. 3,000 square feet). The thermoplastic ultimately faces the paper roll 22 to be wrapped.

As used herein, the term "thermoplastic material" means polymerized resins which are thermoplastic in nature (i.e. becomes softened and flowable upon heating above their thermal softening point without decomposition). Thermoplastics are a well-known class of materials and include polymerized olefins (e.g. polyethylene, polypropylene, and polybutylene) and polymerized vinyls (e.g. polyvinyl chloride, polyvinyl acetate, and various vinyl polymers). The major thermoplastic material used in coating paper is polyethylene, for example recycled milk cartons. The softening temperature of polyethylene is approximately 280 degrees F.

Although a paper coated with thermoplastic is utilized in the present invention, it is expected that other papers coated with other materials which act as heat-activated adhesives can also be used.

The dispensing assembly 14 includes a pair of feed rollers **24*a* and 24*b*, a pair of guide plates 26*a* and 26*b*, and a knife 28. The feed rollers 24 are powered; and the wrapping material 21 extends therebetween to be drawn from the roll 20. At least one of the rollers 24*a* has an encoder thereon enabling the wrapping machine to monitor the length of paper dispensed from the assembly 14. The guide plates 26 are generally parallel one another and define a relatively large open mouth 30 at their upper end to receive the paper from the rollers 24 and guide the paper to the gripper bar 16. A knife 28** is mounted in conventional fashion on plate 26*a* and includes a mechanism (not specifically shown) for transporting the knife horizontally within the slot 32 to cut the wrapping material 21.

The paper roll support 18 includes a pair of rollers **18*a* and 18*b* which are parallel to one another and are powered enabling a paper roll 22** supported thereon to be rotated.

Figure 7:
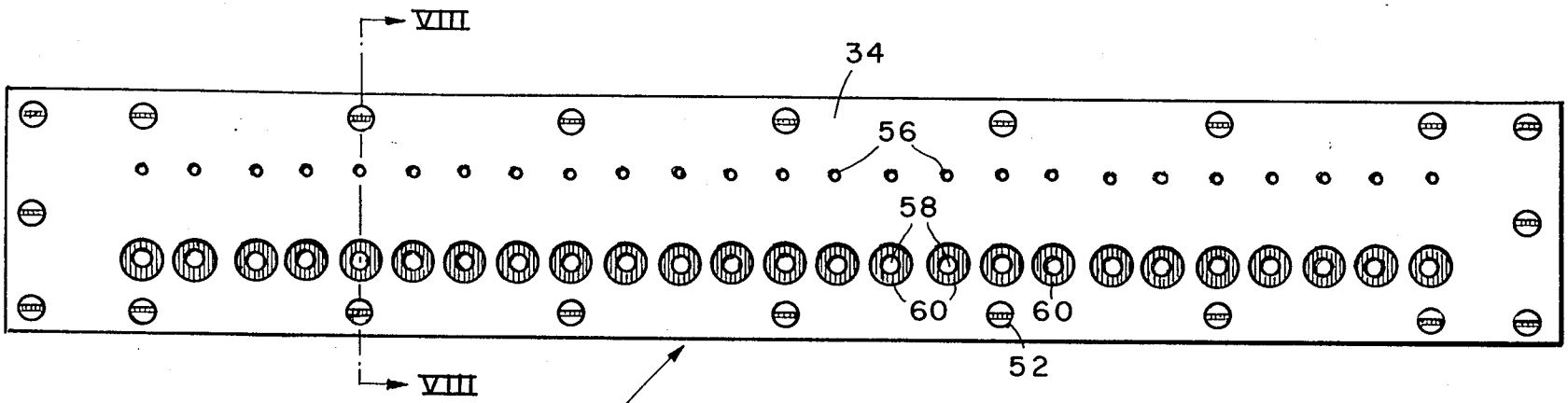
FIG. 7 is a plan view of the paper-receiving face of the gripper bar.
Figure 8:
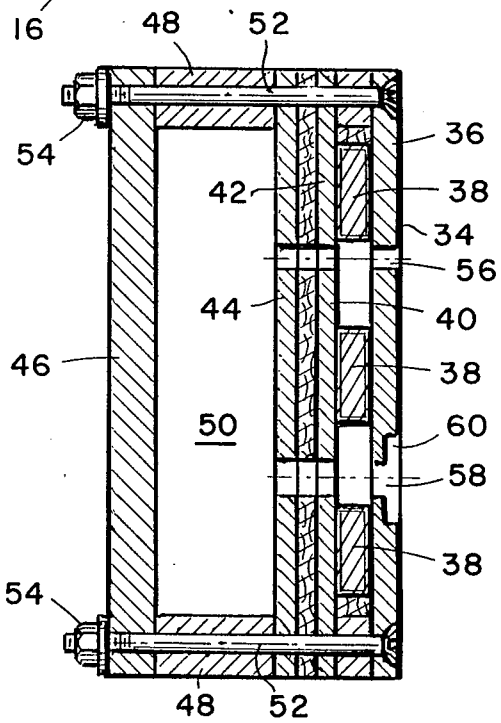
FIG. 8 is a sectional view taken along plane VIII—VIII in FIG. 7.

The gripper bar 16 is illustrated in detail in FIGS. 7 and 8. The bar includes vacuum ports for gripping the paper and a heated face for heating the roll wrapper to tackify the thermoplastic. The heater bar 16 includes a paper receiving face 34 (FIG. 7) which receives the roll wrapping material thereacross. The face 34 is defined by a face plate 36 which is approximately 108 inches long and 8 inches high (note FIG. 7 is not to scale). A plurality of strip heaters 38 are sandwiched between the face plate 36 and an intermediate plate 40. Overlying the intermediate plate 40 is an insulation layer 42 and a base plate 44. A frame plate 46 is spaced from the base plate 44 by leg plates 48 to define a vacuum chamber 50 therebetween. Face plate 36, intermediate plate 40, base plate 44, frame plate 46, and leg plates 48 are all fabricated of aluminum. Bolts 52 with nuts 54 extend through all components of the gripper bar 16 to tie the elements together. Preferably, sufficient strip heaters 38 are included to provide approximately nine watts per square inch over the entire face 34.

A plurality of vacuum ports 56 and 58 extend through the face 34 to the vacuum chamber 50. The upper row of linearly aligned ports 56 are all ¼ inch in diameter and spaced on two-inch centers. The lower row of ports 58 are all ½ inch in diameter and spaced on the same two-inch centers. Each of the lower ports 58 is counterbored at 60 to a diameter of 1⅛ inch.

The vacuum chamber 50 is connected in conventional fashion via a flexible duct 62 to a blower 64. Preferably, the blower 64 is operated to create a vacuum of 27 inches in the chamber 50.

As illustrated in FIG. 1, the gripper bar 16 is transportable in a substantially vertical plane between an uppermost position 16' (shown in phantom) and a lowermost position 16" (also shown in phantom). The transportation mechanism for the gripper bar 16 is conventional and well known in the art.

Operation

Figure 3:
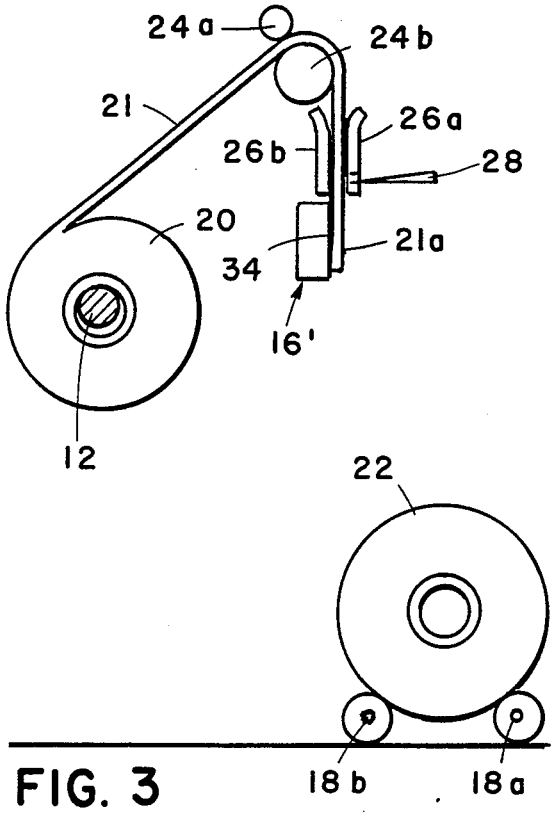
FIGS. 3–6 are side elevational views of the roll wrapping machine illustrating its operation.
Figure 4:
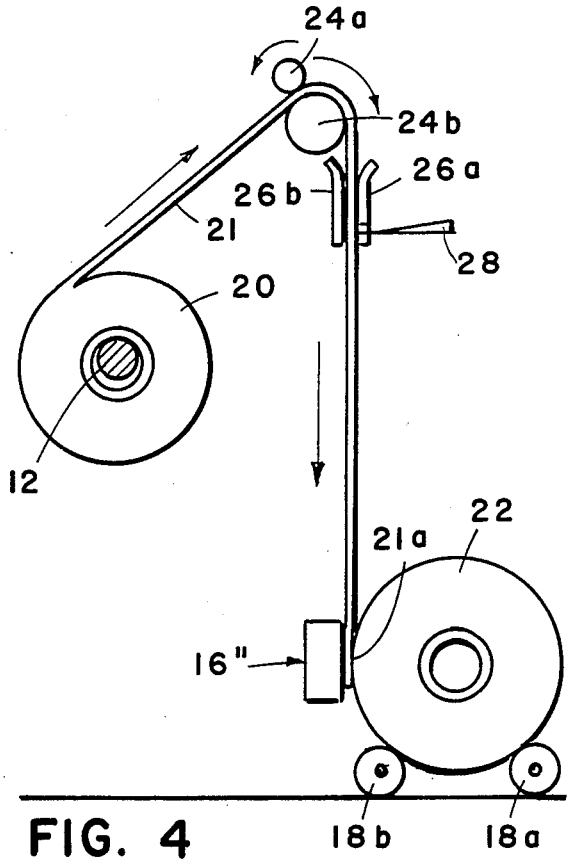

The operation of the roll wrapping machine 10 is illustrated in FIGS. 3–6. First, a paper roll 22 to be wrapped is supported on rollers **18*a* and 18*b*. Rollers 24 are actuated to dispense the wrapping sheet 21 so that a leading edge portion 21*a* is positioned over the gripper bar face 34 (FIG. 3). The arrangement of the vacuum ports 56 and 58 (see FIGS. 7 and 8) is important to insure proper positioning of the paper on the gripper bar face. As the wrapper is slid downwardly over the gripper bar face 34, the vacuum provided by the small ports 56 slows the wrapper down without actually stopping it. The greater vacuum provided by the larger ports 58 with the counterbores 60** stops the wrapper completely and securely grips the wrapper.

The gripper bar 16 is then transported to its lower position 16" tangential to the paper roll 22. The gripper bar 16 holds the leading edge **21*a* with the thermoplastic against the paper roll. The heat provided by the gripper bar 16 raises the temperature of the thermoplastic above its softening point so that the thermoplastic acts as an adhesive to secure the leading edge 21*a* to the paper roll 22. Gripper bar 16 is maintained in the position illustrated in FIG. 4 for approximately 9 seconds to insure proper securement of the leading edge 21*a* to the paper roll 22**.

Figure 5:
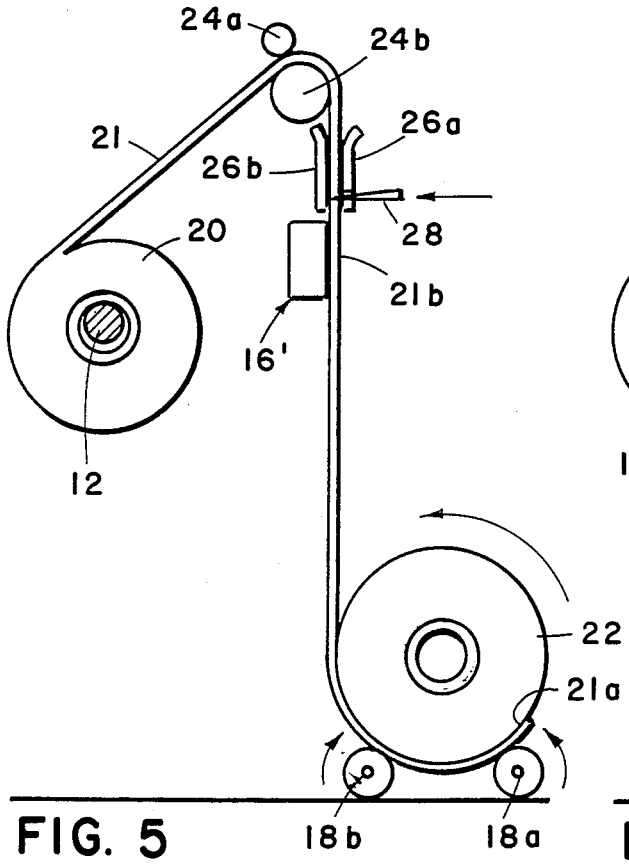

Two actions then take place as illustrated in FIG. 5. The gripper bar 16 returns to its uppermost position 16' adjacent the dispensing mechanism 14; while the paper roll 22 is rotated by the roller 18. Rotation of the roll 22 pulls the wrapping material 21 about the paper roll and thereby effects wrapping. The encoder (not shown) on rollers 24 measures the paper dispensed from the knife 28 since the last cutting operation. When the proper length has been dispensed, the knife 28 is actuated in conventional fashion to sever a wrapper from the material 21. Preferably, the length of the wrapper is greater than the circumference of the roll 22 so that the trailing edge of the wrapper will be adhered to the wrapping as will be described.

Figure 6:
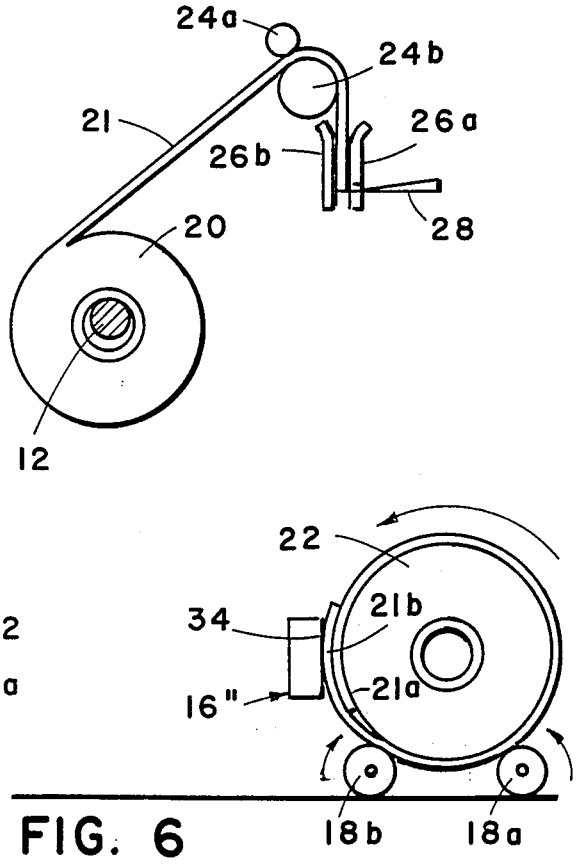

FIG. 6 illustrates the completion of the roll wrapping operation. The gripper bar 16 moves downwardly to its lower position 16" as the roll 22 continues to rotate until the trailing edge **21*b* is positioned over the wrapping material. At this point, the gripper bar face 34 is again tangential to the paper roll 22. The gripper bar is held in this lower position 16" again for approximately nine seconds to insure that the softened or tackified thermoplastic properly adheres to the underlying layer of wrapping material. When wrapping is complete, gripper bar 16 returns to its uppermost position 16' to receive the new leading edge of the continuous web 21**.

The ends of the wrapper on the roll 22 are crimped in conventional fashion; and headers, or paper disks, may be adhered to either end of the crimped wrapper ends. A conventional roll ejector (not shown) is then actuated to eject the wrapped roll 22 from the support assembly 18.

The present invention totally eliminates the need for using liquid adhesive applicators with their attendant maintenance, servicing, and down-time problems. Second, the wrapped rolls are extremely neat and uniformly sealed without unsightly glue overlap or slop. Third, the poly-coated wrapping paper creates more effective moisture protection than has previously been available.

The above description is that of a preferred embodiment of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A method of wrapping a paper roll comprising:
   providing a continuous web of roll wrapping material having a thermoplastic coating on one side thereof;
   adhering a leading edge portion of said continuous web to the paper roll by grasping the leading edge portion with a heatable bar, heating the thermoplastic above its softening point in the leading edge portion, transporting the grasped leading edge portion into contact with the paper roll, and contacting the softened thermoplastic to the paper roll;

rotating the paper roll to draw the continuous web about the roll;

cutting a roll wrapper from the continuous web, the roll wrapper having a length greater than the circumference of the roll;

adhering a trailing edge portion of the roll wrapper to the roll wrapper drawn about the paper roll by grasping the trailing edge portion with a heatable bar, heating the thermoplastic above its softening point in the trailing edge portion, transporting the grasped trailing edge portion into contact with the paper roll, and contacting the softened adhesive to the roll wrapper to complete securement of the roll wrapper about the roll.

2. A method as defined in claim 1 wherein the thermoplastic forms a continuous coating on one side of the roll wrapping material to create a continuous vapor barrier on the wrapped roll.

3. A method of wrapping a paper roll comprising:

providing a roll wrapper having a heat-activated adhesive on one side thereof;

adhering a leading edge portion of the roll wrapper to a paper roll by grasping the leading edge portion with a heated bar, heat-activating the adhesive in the leading edge portion, and moving the bar with the grasped leading edge portion to contact the leading edge portion to the paper roll;

wrapping the roll wrapper about the paper roll;

adhering a trailing edge portion of the roll wrapper to the roll wrapper by grasping the trailing edge portion with a heated bar, heat-activating the adhesive in the trailing edge portion, and moving the bar with the grasped trailing edge portion to contact the trailing edge portion to the paper roll.

4. A method as defined in claim 3 wherein said heat-activated adhesive comprises a thermoplastic.

5. A method as defined in claim 4 wherein the thermoplastic is continuously coated on one side of the roll wrapper to form a vapor barrier on the wrapped roll.

6. An apparatus for wrapping paper rolls comprising:

support means for supporting and rotating a paper roll;

roll wrapper dispensing means for supporting a continuous web of roll wrapper;

a transport bar means for grasping a portion of the roll wrapper, said bar means including means for moving said bar means to transport the grasped portion from said dispensing means to a paper roll on said support means, said bar means further including means for heating said transport bar means to activate a heat-activated adhesive on a roll wrapper and adhere the wrapper to the roll.

7. An apparatus as defined in claim 6 wherein said transport bar means defines a gripping face with vacuum ports opening therethrough, said ports varying in at least one of spacing and size to provide different amounts of gripping force at different locations on said gripping face.

8. An apparatus as defined in claim 7 wherein said gripping face includes a receiving face portion and a releasing face portion, said dispensing means arranged to dispense the continuous web across said gripping face from said receiving face portion to said releasing face portion, the gripping force in said releasing face portion being greater than the gripping force in said receiving face portion.

9. A roll wrapper apparatus comprising:

a roll wrapper dispensing assembly;

a paper roll support assembly for rotating a paper roll; and a heating assembly for heating portions of a roll wrapper dispensed from the dispensing assembly and for contacting the heated portions with the paper roll, whereby said roll wrapper apparatus can adhere a roll wrapper having a heat-activated adhesive to a paper roll, said heating assembly including a heatable gripper bar for selectively gripping the roll wrapper and heating the portions thereof, said gripper bar including a paper-receiving face and vacuum means for drawing a partial vacuum against said face, said partial vacuum varying in a selected fashion across said face to control roll wrapper movement thereover.

* * * * *